United States Patent [19]

Lepere et al.

[11] 4,355,490

[45] Oct. 26, 1982

[54] MULTISTATION BLAST PROCESSING APPARATUS

[75] Inventors: Henri G. Lepere, Schaffhausen; Wolfgang Walter, Hallau, both of Switzerland

[73] Assignee: Georg Fischer Aktiengesellschaft, Switzerland

[21] Appl. No.: 162,573

[22] Filed: Jun. 24, 1980

[30] Foreign Application Priority Data

Jun. 29, 1979 [CH] Switzerland ..... 6090/79

[51] Int. Cl.[3] ..... B24C 3/18; B24C 9/00

[52] U.S. Cl. ..... 51/419; 51/426

[58] Field of Search ..... 51/417, 419, 420, 421, 51/426, 108 R, 215 AR, 164.2

[56] References Cited

U.S. PATENT DOCUMENTS

| | | | |
|---|---|---|---|
| 1,898,648 | 2/1933 | Thorsen | 51/108 R |
| 2,629,207 | 2/1953 | Gladfelter | 51/419 |
| 3,146,550 | 9/1964 | Millhiser | 51/419 |
| 3,153,882 | 10/1964 | Millhiser | 51/421 |
| 3,814,817 | 6/1974 | Haberlin | 51/426 |
| 4,001,977 | 1/1977 | Schrader | 51/419 |

FOREIGN PATENT DOCUMENTS 2813705 5/1978 Fed. Rep. of Germany .

*Primary Examiner*—Stephen G. Kunin
*Assistant Examiner*—Robert A. Rose
*Attorney, Agent, or Firm*—Roylance, Abrams, Berdo & Farley

[57] ABSTRACT

A multistation blast processing machine has a conveyor formed as a wheel (2) for workpieces (6) held in several receiving chambers (5) by means of holding devices (13, 13*a*). Two workpieces (6) are held in axially spaced relationship in each chamber and are conveyed by cyclic rotation of the wheel (2) to two blast processing stations (8, 8*a*) and into one loading and discharging station (7). The chambers (5) distributed evenly over the periphery are separated by walls (9) attached to the wheel (2) so that they form, with the surrounding blast housing (1), closed blasting chambers (10) in the area of the blast processing stations (8, 8*a*). This permits blast processing of the workpieces (6) in two stations even during the drum processing, discharging and loading of the workpieces in the third station.

9 Claims, 2 Drawing Figures

Figure 1:
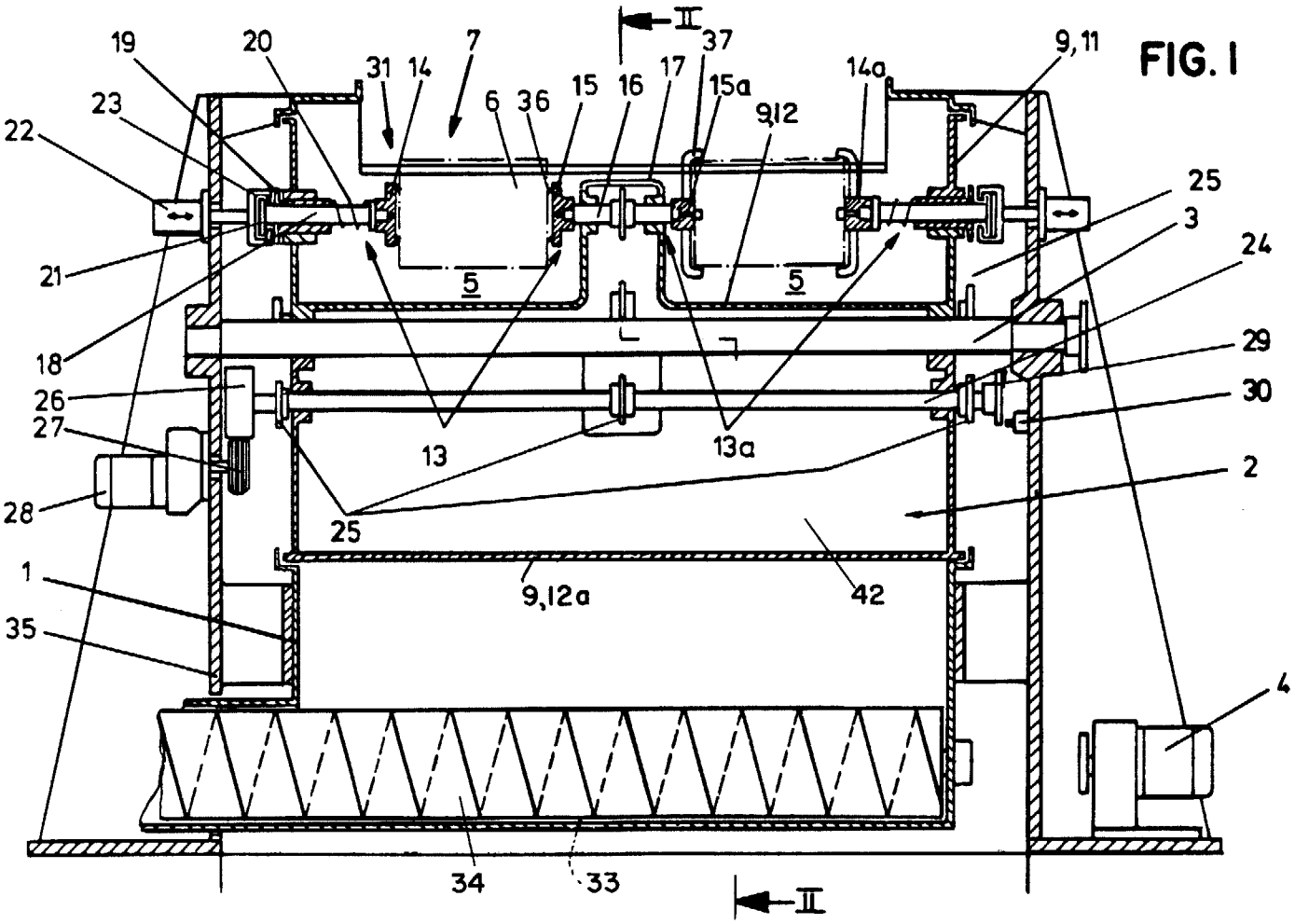

4
2
30
29
24
3
25
9,11
14a
9,12
5
37
15a
17
16
15
36
6
7
31
14
20
19
23
22
21
18
26
27
28
1
35
34
33
42
9,12a
13a
13
25
II

MULTISTATION BLAST PROCESSING APPARATUS

This invention relates to a multistation blast processing machine having a workpiece conveyor of a revolving type.

BACKGROUND OF THE INVENTION

The general field of this invention involves blast processing of workpieces, such as castings or the like, which are to be subjected to streams of granular or pellet-like blasting material to clean the castings and remove unwanted portions thereof.

A machine for this purpose is shown in German Offenlegungsschrift No. 28 13 705 (A counterpart application to which was filed in Great Britain, Application No. 13759-77, filed Apr. 1, 1977) wherein workpieces to be cleaned, such as motor blocks or cylinder heads, are inserted into carriers which have horizontal legs and which have an open side, the workpieces being placed on the carriers and removed therefrom at separate loading and discharging stations through a blasting region wherein they are hit by the blasting means in an undefined manner by the blasting medium impelled by fan blowers disposed in the upper part of the blast housing. When the articles are to be loaded and unloaded from this drum processing apparatus, the blasting wheels must be turned off.

In this case, it is a disadvantage that none of the revolving workpieces are processed by the blast during the loading and unloading period, as a result of which the time of passage for one workpiece is significantly prolonged and the machine therefore has a low degree of effectiveness. Furthermore, the workpieces are not held in a perfectly axial relationship in the carriers which makes possible their shifting during passage, leading to breakdowns.

A different conveying arrangement by means of a fan blast installation is known from German Pat. No. 22 124 87, which corresponds to U.S. Pat. No. 3,813,817, wherein the workpieces are held by means of carrying yoke legs at both front sides and the pieces are conveyed rotatingly along through a centrifugal blast machine. This conveying arrangement, however, is not connected with the previously mentioned type of multistation blast processing machine. Moreover, a centrifugal blast machine charged with such a conveying arrangement has large dimensions as compared with its workpiece capacity.

BRIEF DESCRIPTION OF THE INVENTION

Accordingly, it is an object of the present invention to provide a compact, multistation blast processing machine of the type wherein a high throughput of workpieces can be achieved with the least possible idle time and with which a uniform blasting effect is achieved on workpieces of various shapes with secure and immovable workpiece holding during the blast processing.

Briefly described, the present invention includes a multistation blast processing apparatus comprising a blast housing having a generally cylindrical shape, a generally horizontal axis and an open side, workpiece conveying means rotatable about the generally horizontal axis supporting a plurality of workpieces, the conveying means including a plurality of walls for separating the interior of the housing into at least two chambers, the chambers being rotatable to a loading and unloading station adjacent the open side of the housing and to at least one blast processing station within the housing, holding means at each of the chambers for clamping at least one workpiece therein, the holding means being rotatable to rotate the at least one workpiece about an axis generally parallel with the axis of the rotation of the conveying means, and means on the housing for propelling a blasting agent toward a workpiece at the at least one blast processing station.

As a result of the formation of at least one closed blasting chamber in the housing, the loading and discharging area is shielded against the blasting agent. Thus, as a result of this arrangement, when blast processing is occurring at the processing stations the workpieces in the processing station can be blasted while new workpieces can be loaded or unloaded at the receiving station, considerably decreasing the idle time. Despite accessibility of the blasting agent to the front side of the workpieces, a fixed axial support is achieved as a result of a holding device clamping the workpieces on the front side and the possibility for the reception of two workpieces in one receiving station can be provided, which workpieces are inserted simultaneously in a short loading time radially into the receiving station.

The apparatus can be provided with three chambers, each of which can receive two workpieces, there being thus a loading and discharging station and two blast processing stations, resulting in compact construction of the machine with short transit times of the workpieces. The workpieces can also be provided with rotational drives independent of the rotation of the conveying means, permitting variation of the rotation of the workpieces themselves between the various stations possible, and variation of the direction of rotation and times of non-rotation of the work workpieces is possible at the individual stations as well as maintaining a certain holding position in the loading and discharging station.

In order that the manner in which the foregoing and other objects are attained in accordance with the invention can be understood in detail, particularly advantageous embodiments thereof will be described with reference to the accompanying drawings, which form a part of this specification, and wherein:

FIG. 1 is a side elevation, in longitudinal section, of a machine in accordance with the invention;

and

Figure 2:
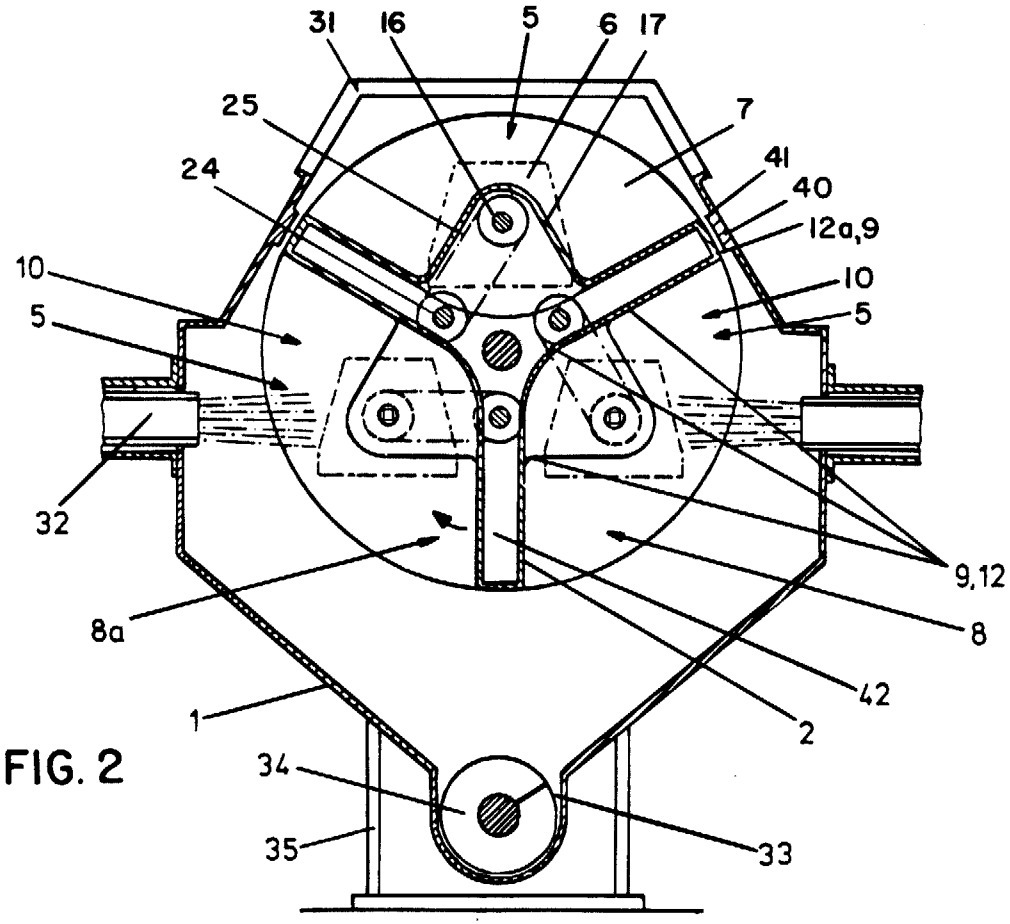

FIG. 2 is an end elevation, in transverse section, through the apparatus of FIG. 1 along line II—II thereof.

As shown in the drawings, the multistation blast processing machine has a blast housing 1 which is generally cylindrical in shape and which contains a conveyor mechanism 2 which is generally wheel-like or drum-like in configuration and which is rotatable about a horizontally disposed axle 3 so that the drum 2 can be driven by a motor 4, the motor being coupled to axle 3 by a belt or chain drive coupled to appropriately placed pulleys. The wheel 2 is formed so as to have three chambers 5 which are capable of receiving workpieces 6 circularly and symmetrically placed around conveying structure 2 so that the workpieces can be brought, in time sequence, to a loading and discharging station 7 and to two blast processing stations 8 and 8*a* within the blast housing. The chambers 5 are defined by walls 9 which are part of the rotating conveyor mechanism formed by the wheel 2 and which cooperate with the surrounding housing 1 to form closed blasting chambers 10 in the areas of blast processing stations 8 and 8*a*. The walls 9 are radially extending walls running generally perpendicular to axle 3 having arcuate intermediate portions 12 and 12*a* joining the inner and outer limits respectively, of the walls 9, walls 12*a* being substantially parallel with a tangent line to the axis. The walls 12*a* being outside the outer periphery of the wheel-like conveyor structure, cooperate with strips 40 formed on the inner surfaces of housing 1 to define a relatively narrow sealing gap 41 between the blast chambers 10 and the loading and unloading station 7, best seen in FIG. 2. For the purpose of completely isolating and sealing the loading and unloading station from the blast chambers, elastic gaskets can be provided on strips 40, extending inwardly to contact walls 12*a*. As will be recognized, walls 9, 12 and 12*a* form a hollow space 42 within the wheel 2.

In the embodiment shown, the chambers 5 each have two holding devices 13, 13*a* which function to clamp the workpieces 6 which are therefore disposed in axially spaced relationship with each other, the holding devices acting on the front or end portions of the workpieces. Each holding device 13, 13*a* includes an axially shiftable holding part 14 and 14*a* and an axially fixed part 15, 15*a*. The holding parts 15, 15*a* of the two successive holding devices 13, 13*a* are replaceably attached to a common shaft 16, the shaft being rotatably mounted in a bearing block 17 attached to walls 12.

The holding parts 14 and 14*a* are replaceably attached to a shaft 18, which shaft is mounted so as to be axially shiftable in a bushing 19 and is torsionally connected with the bushing. Between bushing 19 and the holding part 14, 14*a* a spring 20 is mounted on the shaft 18 to urge the holding parts 14, 14*a* toward the closest side of workpiece 6. Each bushing 19 is rotatably mounted in the lateral walls 11 of wheel 2.

The shafts 18 are provided at their outside ends with a collar 21 which establishes, at the loading and unloading station 7, the active connection of the holding parts 14, 14*a* with a fixed operating element 22, preferably a hydraulically or pneumatically operated piston and cylinder assembly. This is accomplished as a result of the fact that the collar 21, during rotation of the wheel 2, moves into a T-slot recess in element 23 of operating element 22.

Three shafts 24 mounted in the lateral walls 11 extend in parallel relationship to axle 3 within walls 12, 12*a*, the shafts being connected for rotation by means of chain or belt drives 25 with the bushings 19 and shafts 16. Wheels 26 are mounted at the end of each of shafts 24 and are arranged to come into contact with a fixed wheel 27 which is fixedly disposed in such a position that wheel 27 is actively coupled to wheel 26 when the station associated with the shaft carrying wheel 26 is at one of the loading and discharging station 7 or the blast processing stations 8 and 8*a*. Thus, when the entire assembly 2 rotates to a position in which the chambers are aligned with respective stations, wheels 26 and 27 are coupled so that the drive wheel 27 drives the driveable wheel 26, rotating its associated shaft and causing rotation of the workpieces, through the drive train described. The wheels 26 and the driving wheels 27 can be formed, preferably as friction wheels but could be gears.

The driving wheels 27 are connected to a geared motor 28 which is reversible and speed-variable so that the workpiece holding devices 13, 13*a* in the stations can be controlled as to direction of rotation as well as rotational speed. As a result of the arrangement of the shafts 18 and chain drives 25 either in the hollow space 42 or outside of the traverse walls 11, the entire rotational drive for the workpieces is protected from the blasting medium.

At the other end of each of shafts 24 are control discs 29 which cooperate with a control member 30, which is preferably a limit switch, disposed in conjunction with the loading and unloading station, for the purpose of stopping the rotation of holding device 13, 13*a* in a predetermined loading and unloading position.

Control members 30, likewise shiftable by the control disc 29, can be disposed in the blast processing station 8, 8*a* as a result of which certain blast processing programs are controllable depending upon the position of each of workpieces 6 located therein.

The blast housing 1 has, in the upper region thereof, an opening 31 through which the loading and unloading station 7 is accessible from the outside for insertion and removal of workpieces. The opening 31 can conveniently be closed by a lid, not shown in detail. Blasting wheel units 32 are disposed on the lateral walls of housing 1, two of the units being attached on one side belonging to one of blast processing stations 8 or 8*a*.

The lower part of the blast housing 1 is formed as a cavity 33 which contains a screw conveyor 34 for the removal of blasting agent and particles blasted off of the workpieces. The blast housing 1 is attached to a frame 35 in which axle 3 of the wheel 2 is rotatably mounted and on which the driving motors 28, operating elements 22 and the driving motor 4 are supported.

Workpieces 6 can be held at their ends by means of points 36 disposed on holding parts 14 and 15 (as shown in FIG. 1 at the lefthand side) in the chambers 5, or, alternatively, they may be held in the front and peripheral portions by means of holding arms 37 mounted on the holding parts 14*a* and 15*a* as shown in FIG. 1 on the righthand side. The type of grasping mechanism employed depends on the shape of the workpieces, and it will be recognized that more than one type of grasping device can be used in a single form of the apparatus, if desired, as shown.

The method of operation of the apparatus as described is as follows. Two workpieces 6 are moved into a chamber 5 simultaneously by means of a loading mechanism, not shown, through the opening 31 of the housing while one of the chambers is aligned with the loading and unloading station 7, and the workpieces are grasped firmly therein by means of the holding devices 14, 14*a* and 15, 15*a* by spring tension in the holding devices 13, 13*a*.

Subsequently, the wheel 2 is rotated through an angle of 120°, causing the previously loaded workpieces 6 to be moved to the first blast processing station 8, and the workpieces 6 are caused to rotate simultaneously by the wheel 26 being brought into engagement with the driving wheel 27, permitting the workpieces to be processed on all sides by means of the blast of blasting medium delivered by the blasting wheel units 32. Simultaneously, the second chamber 5 can be loaded with additional workpieces 6.

After an additional rotation of wheel 2 through an angle of 120°, the first-loaded workpieces 6 reach the second blast processing station 8*a* and the third chamber 5 can be loaded with more workpieces. Meanwhile, the first loaded workpieces are subjected to treatment in the second blasting chamber, and the second loaded workpieces are subjected to treatment in the first blast processing chamber. When the blast treatment is completed, the wheel is further rotated by 120° and the completely blasted workpieces 6 reach the loading and unloading station 7. At that station they are caused to rotate once more by means of the driving motor 28 disposed at that station in order to cause the hollow spaces of the workpiece to empty themselves of blasting agent which may have lodged therein. The used blasting agent remains on intermediate walls 12 of that particular chamber 5 until, when the wheel 2 is further rotated, it flows down into the cavity 33. When the drum processing is completed, the driving motor is switched off by control disk 29 and control organ 30 so that the workpieces 6 come to a stop in a predetermined discharge position. The workpieces 6 are then engaged by the gripper of the loading device, the shafts 18 are axially shifted against the pressure of springs 20 by switching on operating elements 22 and the holding parts 14, 14*a* are released from the workpieces. The workpieces can then be extracted by the loading device and new pieces inserted into the exposed, empty chamber 5.

During the drum processing and the discharging and loading at station 7, the remaining workpieces in stations 8 and 8*a* can be blast processed in chambers which are sealed off from the station 7 by walls 9.

It is also possible to arrange only two chambers, or more than three chambers on a wheel 2 in which case only one blasting station is provided or, in the case of more than three chambers, more than two blast processing stations are arranged in the blast housing.

As a result of the arrangement of three chambers with two axially disposed workpieces in each chamber, a compact machine results with high capacity wherein both workpieces in each chamber are simultaneously blast treated on all sides. By providing sliding doors on the blast housing at the loading and discharging station, it is not necessary to de-energize the blasting wheels during the continued cyclic movement of the wheel 2 and its associated chambers.

The individual rotational drives for the workpieces, which are protected from the blasting agent, makes possible the use of variable rotational programs for the workpieces in each blast processing station and in the loading and unloading station, which programs may be adapted to the shape of the workpieces in order to achieve a uniform blast treatment. The apparatus thus described is suitable particularly for workpieces which can not be tumbled in conventional drum processing, such as motor blocks, cylinder heads, gear housings and the like.

While certain advantageous embodiments have been chosen to illustrate the invention, it will be recognized by those skilled in the art that various changes and modifications can be made therein without departing from the scope of the invention as defined by the appended claims.

What is claimed is:

1. A multistation blast processing apparatus comprising a blast housing having a generally cylindrical shape, a generally horizontal axis and an open side located at the upper part of said housing;

workpiece conveying means rotatable about said generally horizontal axis for supporting a plurality of workpieces, said conveying means including a plurality of walls for separating the interior of said housing into at least two chambers, said chambers being rotatable to be sequentially positionable at a loading and unloading station at said open side of said housing and to at least one blast processing station within said housing, a driven shaft operatively associated with each said chamber, said shaft being translatable as said chambers are rotated, and holding means at each of said chambers for clamping at least one workpiece therein, each of said holding means being rotatable to rotate said at least one workpiece about an axis generally parallel with the axis of rotation of said conveying means;

means on said housing for propelling a blasting agent toward a workpiece at said at least one blast processing station;

a control disc on each of said driven shafts; and control means mounted on said housing and engageable by said control disc for stopping said driven shafts in a predetermined position.

2. An apparatus according to claim 1 wherein the holding means at each of said chambers includes means for supporting two axially spaced workpieces.

3. An apparatus according to claim 2 wherein each of said chambers includes a power driven shaft extending parallel with said generally horizontal axis and a belt-like element coupling said shaft to said holding means.

4. An apparatus according to claim 1 which includes three said walls for separating said housing interior into three substantially symmetrical chambers.

5. An apparatus according to claim 4 wherein said housing includes two blast processing stations.

6. An apparatus according to claim 5 wherein each of said chambers includes a power driven shaft extending parallel with said generally horizontal axis and a belt-like element coupling said shaft to said holding means.

7. An apparatus according to claim 6 wherein each said driven shaft carries a drivable wheel, the shaft and wheel being rotatably translated with said conveying means;

and wherein each of said blast processing stations includes a power driven wheel located to engage said drivable wheel when the chamber associated with said shaft and wheel is moved to the station so that said driven and drivable wheels are actively coupled to each other for rotating said shaft.

8. A multistation blast processing apparatus comprising a blast housing having a generally cylindrical shape, a generally horizontal axis and an open side in the upper part of said housing;

workpiece conveying means rotatable about said generally horizontal axis for supporting a plurality of workpieces, said conveying means including a plurality of walls for separating the interior of said housing into at least two chambers, said chambers being rotatable to be sequentially positionable at a loading and unloading station adjacent said open side of said housing and to at least one blast processing station within said housing, holding means at each of said chambers for clamping two axially spaced workpieces therein, said holding means being rotatable to rotate said workpieces about an axis generally parallel with the axis of rotation of said conveying means, each of said chambers including a power driven shaft extending parallel with said generally horizontal axis and a belt-like element coupling said shaft to said holding means, and wherein each said driven shaft carries a drivable wheel, the shaft and wheel being rotatably translated with said conveying means, and each of said blast processing stations includes a power driven wheel located to engage said drivable wheel when the chamber associated with said shaft and wheel is moved to the station so that said driven and drivable wheels are actively coupled to each other for rotating said shaft; and means on said housing for propelling a blasting agent toward a workpiece at said at least one blast processing station;

a control disc on each of said shafts; and control means mounted on said housing and engageable by said control disc for stopping said holding means in a predetermined position.

9. An apparatus according to claim 1 or 8 wherein each of said holding means includes an axially shiftable holding element having spring means for urging said holding element into engagement with a workpiece and means for retracting said holding element from the workpiece when the chamber associated therewith is at said loading and unloading station.

* * * * *